US008597866B2

(12) United States Patent
Takahashi et al.

(10) Patent No.: US 8,597,866 B2
(45) Date of Patent: Dec. 3, 2013

(54) METHOD OF PRODUCING A CARRIER FOR ELECTROPHOTOGRAPHY AND METHOD OF PRODUCING A DEVELOPER FOR ELECTROPHOTOGRAPHY

(75) Inventors: Sakon Takahashi, Kanagawa (JP); Norihito Fukushima, Kanagawa (JP); Shunsuke Nozaki, Kanagawa (JP); Michio Take, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 530 days.

(21) Appl. No.: 12/558,074

(22) Filed: Sep. 11, 2009

(65) Prior Publication Data

US 2010/0233615 A1 Sep. 16, 2010

(30) Foreign Application Priority Data

Mar. 10, 2009 (JP) ..... 2009-056230

(51) Int. Cl.
*G03G 9/113* (2006.01)

(52) U.S. Cl.
USPC ..... 430/137.13; 430/111.35

(58) Field of Classification Search
USPC ..... 430/137.13, 111.35
See application file for complete search history.

(56) References Cited

U.S. PATENT DOCUMENTS

| | | | | |
|---|---|---|---|---|
| 5,527,558 | A * | 6/1996 | Daidoji et al. | 430/137.13 |
| 5,573,880 | A * | 11/1996 | Mayama et al. | 430/137.13 |
| 5,705,306 | A | 1/1998 | Kitani et al. | |
| 5,849,448 | A | 12/1998 | Yoshino et al. | |
| 5,919,593 | A | 7/1999 | Karima et al. | |
| 5,968,699 | A * | 10/1999 | Matsuzaki et al. | 430/111.35 |
| 6,372,401 | B1 * | 4/2002 | Matsuzaki et al. | 430/137.13 |
| 7,166,404 | B2 * | 1/2007 | Matsuda et al. | 430/111.35 |
| 8,148,041 | B2 * | 4/2012 | Kobayashi et al. | 430/137.13 |
| 2010/0248116 | A1 * | 9/2010 | Kamoto et al. | 430/137.13 |

FOREIGN PATENT DOCUMENTS

| | | | | |
|---|---|---|---|---|
| JP | A-5-216281 | | 8/1993 | |
| JP | A-6-110253 | | 4/1994 | |
| JP | 06308775 | A * | 11/1994 | G03G 9/113 |
| JP | A-7-140721 | | 6/1995 | |
| JP | A-7-181746 | | 7/1995 | |
| JP | A-9-6039 | | 1/1997 | |
| JP | A-9-269614 | | 10/1997 | |
| JP | 09319155 | A * | 12/1997 | G03G 9/113 |
| JP | A-10-177279 | | 6/1998 | |
| JP | A-11-125934 | | 5/1999 | |
| JP | A-11-231574 | | 8/1999 | |
| JP | A-2000-231225 | | 8/2000 | |
| JP | 2001117288 | A * | 4/2001 | G03G 9/113 |
| JP | A-2004-198663 | | 7/2004 | |

(Continued)

OTHER PUBLICATIONS

English language machine translation of JP 06-308775 (Nov. 1994).*
English language machine translation of JP 09-319155 (Dec. 1997).*
English language machine translation of JP 2001-117288 (Apr. 2001).*

(Continued)

*Primary Examiner* — Christopher Rodee
(74) *Attorney, Agent, or Firm* — Oliff & Berridge, PLC

(57) ABSTRACT

A method of producing a carrier for electrophotography includes: covering a surface of a core particle with a coating layer including resin particles and a crosslinking resin in an uncrosslinked state present in spaces between the resin particles; and applying a mechanical impact from the outer surface of the coating layer before crosslinking of the crosslinking resin.

13 Claims, 3 Drawing Sheets

(56) References Cited

FOREIGN PATENT DOCUMENTS

| | | | |
|---|---|---|---|
| JP | A-2004-198664 | | 7/2004 |
| JP | A-2005-24580 | | 1/2005 |
| JP | A-2009-25487 | | 2/2009 |
| KR | 10-0432760 | | 10/2004 |
| WO | WO97/03383 | A1 | 1/1997 |

OTHER PUBLICATIONS

Japanese Office Action issued in Japanese Patent Application No. 2009-056230 on Jan. 25, 2011 (with translation).
Dec. 14, 2012 Office Action issued in Korean Application No. 10-2009-0086894 (with English translation).

* cited by examiner

METHOD OF PRODUCING A CARRIER FOR ELECTROPHOTOGRAPHY AND METHOD OF PRODUCING A DEVELOPER FOR ELECTROPHOTOGRAPHY

CROSS-REFERENCE TO RELATED APPLICATION

This application claims priority under 35 USC 119 from Japanese Patent Application No. 2009-056230 filed on Mar. 10, 2009.

BACKGROUND

1. Technical Field

The present invention relates to a method of producing a carrier for electrophotography, and a method of producing a developer for electrophotography.

2. Related Art

Methods for visualizing image information through an electrostatic latent image such as electrophotography are currently used in various fields. In electrophotography, an electrostatic latent image formed on a photoreceptor by a charging process and an exposure process is developed by a developer containing a toner, and is visualized through a transfer process and a fixation process. Examples of a developer for use in the development include two-component developer containing a toner and a carrier and one-component developer containing only a toner, such as a magnetic toner. As a carrier for use in two-component developer, a carrier containing core particles and a coating layer that contains a resin and covers the core particles is currently used widely.

SUMMARY

According to a first aspect of the invention, there is provided a method of producing a carrier for electrophotography, including:

covering a surface of a core particle with a coating layer including resin particles and a crosslinking resin in an uncrosslinked state present in spaces between the resin particles; and applying a mechanical impact from the outer surface of the coating layer before crosslinking of the crosslinking resin.

BRIEF DESCRIPTION OF THE DRAWINGS

Exemplary embodiments of the present invention will be described in detail based on the following figures, wherein.

DETAILED DESCRIPTION

Carrier for Electrophotography

A carrier for electrophotography according to an exemplary embodiment of the invention (hereinafter sometimes referred to as a "carrier of the present exemplary embodiment") includes a core particle and a coating layer that covers the surface of the core particle, in which the coating layer includes resin particles and a crosslinked resin present in spaces between the resin particles, and a mechanical impact is applied from the outer surface of the coating layer before crosslinking of the crosslinked resin.

A method of producing a carrier for electrophotography according to an exemplary embodiment of the invention includes:

covering a surface of a core particle with a coating layer including resin particles and a crosslinking resin in an uncrosslinked state present in spaces between the resin particles; and applying a mechanical impact from the outer surface of the coating layer before crosslinking of the crosslinking resin.

The coating layer in the carrier of the present exemplary embodiment includes resin particles and a crosslinked resin present in spaces between the resin particles, in which a mechanical impact is applied from the outer surface of the coating layer before crosslinking of the crosslinked resin, in other words, when the crosslinking resin is in an uncrosslinked state. In order to form the coating layer, a coating film including resin particles and a crosslinking resin in an uncrosslinked state is formed in advance on the surface of core particles, and a mechanical impact is applied from the outer surface of the coating layer when the crosslinking resin is in an uncrosslinked state. The crosslinking resin refers to a resin having a property such that the resin is crosslinked by a stimulus such as heat, irrespective of whether or not it is already crosslinked.

Figure 1:
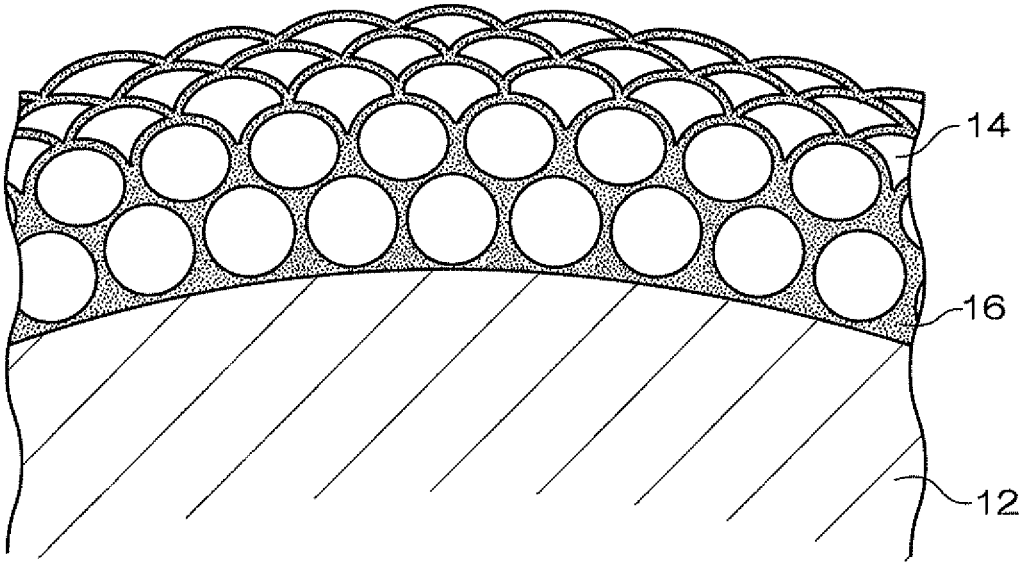
FIG. 1 is an enlarged cross sectional view schematically illustrating the state of a coating layer after a mechanical impact is applied from the outer surface of the coating layer when a crosslinking resin is in an uncrosslinked state.

FIG. 1 is an enlarged cross sectional view schematically illustrating the state of a coating layer after a mechanical impact is applied from the outer surface of the coating layer when a crosslinking resin is in an uncrosslinked state.

As described above, by applying a mechanical impact from the outer surface of the coating layer when the crosslinking resin is in an uncrosslinked state, the surface of the coating layer is smoothened by the mechanical impact as illustrated in FIG. 1. Moreover, a structure is attained in which a crosslinked resin 16 is present in a mesh-like form in the spaces between resin particles 14 that are densely uniformly spread on the surface of a core particle 12.

Moreover, after the application of a mechanical impact, heat may be applied to form the crosslinking resin into a crosslinked resin by the heating, whereby the adhesiveness between the coating layer, and the core particles improves and the adhesiveness between the resin particles also improves.

The resin particles 14 present at a position closer to the outer surface of the coating layer are crushed or deformed owing to the mechanical impact applied from the outer surface of the coating layer as described above. In the invention, granular particles including the crushed or deformed particles are also referred to as the resin particles 14.

The proportion of the resin particles in the coating layer may be high. Specifically, the amount of the resin forming the resin particles in the coating layer is preferably from about 50% by weight to about 98% by weight, more preferably from about 60% by weight to about 95% by weight, and still more preferably from about 70% by weight to about 90% by weight. When the amount is about 50% by weight or more, sufficient impact resistance is obtained. When the amount is about 98% by weight or lower, sufficient hardness of the resin forming the coating layer and sufficient adhesiveness of between the core particles and the coating layer are obtained.

Preferable examples ofthe core particles include particles containing polymer core particles in which a magnetic metal, such as iron, nickel, or cobalt; a magnetic oxide, such as ferrite or magnetite; or magnetic powder is dispersed. The volume average particle diameter of the core particles is preferably in the range of about 10 μm to about 100 μm, and more preferably in the range of about 25 μm to about 50 μm.

Moreover, in order to increase the adhesiveness between the surface of the core particles and the resin of the coating layer, the core particles may be subjected to coupling treatment. Examples of a coupling agent used in the coupling treatment include a silane coupling agent, silicone oil, a titanate coupling agent, and an aluminum coupling agent. These coupling agents may be used singly, or in combination of two or more thereof. Among the above, a silane coupling agent is preferable.

Examples of the resin forming the resin particles include, but not limited thereto, polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, polymethyl methacryl(acryl), a styrene-acrylate copolymer, a straight silicone resin containing an organosiloxane bond or modified products thereof, a fluororesin, polyester, polycarbonate, a nylon resin, a PET resin, an ABS resin, a melamine resin, a guanamine resin, an aramid resin, a phenol resin, and an epoxy resin.

The particle diameter of the resin particles is preferably about 30 nm to about 10 μm, and more preferably from about 80 nm to about 5 μm. When the particle diameter of the resin particles is 30 nm or more, sufficient impact resistance is obtained, and chipping of resultant carrier particles does not occur. When the particle diameter of the resin particles is 10 μm or lower, the number of resin particles per core particle becomes enough, whereby an effect of reinforcement by the crosslinked resin improves.

Examples of the crosslinking resin include, but not limited thereto, a polyurethane resin, a phenol resin, a urea resin, a melamine resin, a guanamine resin, a melamine-urea co-condensation resin, and a silicone resin.

Examples of a preferable combination of the resin particles and the crosslinking resin include a combination of polymethylmethacrylate and a melamine resin and a combination of a nylon resin and a silicone resin.

In an exemplary embodiment of the invention, it is preferable that the coating layer of a carrier includes conductive powder from a viewpoint that the electrical resistance of the coating layer decreases. Examples of the conductive powder include carbon black, metals such as gold, silver, or copper, titanium oxide, zinc oxide, barium sulfate, aluminum borate, potassium titanate, and tin oxide. The amount of the conductive powder in the coating layer is, depending on specific gravity thereof, preferably about 1% by weight to about 50% by weight, and more preferably about 3% by weight to about 20% by weight.

A primary particle diameter of the conductive powder is preferably from about 10 nm to about 2 μm. When the primary particle diameter is within this range, a reduction in resistance of the carrier may be suppressed. The conductive powder has a volume average particle diameter of preferably from about 10 μm to about 100 μm.

Examples of methods for forming the coating layer include the following methods (1) and (2).

Method (1)

A dispersion liquid including resin particles and a crosslinking resin in an uncrosslinked state is applied to the surface of core particles to form a coating film, a mechanical impact is applied to the coating film from the outer surface of the coating film, and then the crosslinking resin in an uncrosslinked state is crosslinked.

Method (2)

A dispersion liquid including resin particles to which a crosslinking resin in an uncrosslinked state has been applied is applied to the surface of the core particles to form a coating film, a mechanical impact is applied to the coating film from the outer surface of the coating film, and the crosslinking resin in an uncrosslinked state is crosslinked.

According to the method (1), a dispersion liquid including resin particles and a crosslinking resin in an uncrosslinked state is applied to the surface of core particles to form a coating film. The dispersion liquid is obtained by adding and dispersing resin particles and a crosslinking resin in an uncrosslinked state in a solvent. Examples of the solvent include methanol, ethanol, propanol, isopropyl alcohol, hexane, cyclohexane, and petroleum ether.

Next, the dispersion liquid including resin particles and a crosslinking resin in an uncrosslinked state is applied to the surface of core particles, thereby forming a coating film (application process). The application is performed using a kneader coater, a fluid bed, a spray dryer, or the like.

A mechanical impact may be applied to the core particles on which the coating film has been formed from the outer surface of the coating film, by, for example, placing and mixing the core particles on which the coating film has been formed in a dry-type processing device, such as NOBILTA (trade name, manufactured by Hosokawa Micron Corporation), a VERTICAL GRANULATOR (trade name, manufactured by Powrex), or a HENSCHEL MIXER (trade name, manufactured by Shimadzu Corporation).

Hereinafter, the description will be given with reference to an example in which NOBILTA is used.

The capacity ratio of NOBILTA to be used is preferably from 10% to 80%, and more preferably from 20% to 70%.

The number of rotations is preferably 500 rpm to 5,000 rpm, and more preferably 800 rpm to 4,000 rpm.

The stirring time is preferably 1 minute to 100 minutes, and more preferably 5 minutes to 80 minutes.

The temperature of the process is preferably 10° C. to 100° C., and preferably 20° C. to 80° C.

Next, the crosslinking resin in an uncrosslinked state in the coating film is crosslinked. The crosslinking is performed by placing the core particles to which a mechanical impact has been applied in a kneader coater or a rotary kiln.

According to the method (2), first, a dispersion liquid including resin particles to which a crosslinking resin in an uncrosslinked state has been applied is prepared. The dispersion liquid is prepared in the same manner as the dispersion liquid including resin particles and a crosslinking resin in an uncrosslinked state in the method (1). The dispersion liquid including resin particles, to which a crosslinking resin in an uncrosslinked state has been applied, is applied to the surface of core particles in the same manner as in the application process in the method (1).

A mechanical impact is applied to the core particles, on which the coating film has been formed by the application process, in the same manner as in the method (1), and the crosslinking resin in an uncrosslinked state is then crosslinked.

The carrier of the present exemplary embodiment has a shape factor SF1, which is represented by the following Equation (A), preferably in the range of from about 100 to about 130, and more preferably in the range of from about 100 to about 120. As the shape factor SF1 is closer to 100 the shape of a carrier is closer to a spherical form. When the shape factor SF1 of the carrier exceeds 130, the carrier particles collide with each other due to distortion of the shape, sometimes resulting in chipping in a convex portion.

$$(ML^2/A)\times(\pi/4)\times100 \quad (A)$$

In Equation (A), ML represents the absolute maximum length (μm) of a carrier particle, and A represents a projected area ($\mu m^2$) of a carrier particle.

The shape factor SF1 is an average value of shape factors, and is calculated by the following method. An optical microscope image of carrier particles that have been scattered on a slide glass and enlarged at a magnification of 250 times is captured in an LUZEX image analyzer (trade name: LUZEX III, manufactured by Nireco Corporation) through a video camera. Then, the SF1 of each particle of 50 carriers is calculated by Equation (A) from the maximum length and the projected area, and the average value is obtained. The shape factor SF1 of the carrier in a developer is determined by placing a developer in water containing a surfactant, separating a toner and a carrier by an ultrasonic wave, taking out only the carrier with a magnet, and conducting the image analysis.

The volume average particle diameter of the carrier is preferably in the range of from about 10 μm to about 100 μm, and more preferably in the range of from about 20 μm to about 60 μm. When the volume average particle diameter of the carrier is larger than 100 μm, the collision energy in a developing device increases. As a result, cracking or chipping of the carrier is accelerated, and, moreover, the surface area for charging a toner becomes small which reduces the toner charging function, whereby image quality may decrease. When the volume average particle diameter of the carrier is smaller than 10 μm, the magnetic force per carrier unit decreases. As a result, the magnetic restriction force on a chain of carrier particles on a magnetic brush becomes weaker than the developing electric field, which may result in an increase in transfer of the carrier to a photoreceptor. The volume average particle diameter of the carrier is further more preferably in the range of 25 μm to 55 μm, and still more preferably in the range of 30 μm to 50 μm.

The volume average particle diameter of the carrier is measured as follows. First 2 mL of 5% aqueous alkyl benzene sodium sulfonate solution is added to 1 g of carrier, and the mixture is added to 10 mL of pure water. One drop of this solution in which the sample (carrier) has been suspended is placed on a slide glass, a cover glass is placed thereon, and 200 photographs thereof are taken with an optical microscope. Next, the maximum widths (particle diameters) of 200 carrier particles captured in the photographs are measured. The measured particle diameter is converted into a volume to be used as a volume particle diameter. A distribution of the obtained volume particle diameters is created. A volume accumulation distribution is drawn from a small particle diameter side, and the particle size at which the volume accumulation reaches 50% is defined as a volume average particle diameter D50v to be used as the particle diameter of the carrier.

The accumulated total of particle size in the range (volume distribution) of 25 μm or lower in the measurement results is defined as the amount (%) of fine powder of 25 μm or lower of the carrier, and is used as an index indicating the occurrence of cracking of the carrier particles.

A wax may be further blended in the coating layer of the carrier. A wax is hydrophobic and relatively soft and provides a low film strength. These properties result from the molecular structure of a wax. Due to these properties, when a wax is present in the coating layer, particles, referred to as an external additive, added to the toner surface or toner components, such as a toner bulk components, hardly adhere to the carrier surface. Even when they adhere to the carrier surface, the wax has an effect such that the surface at the adhesion area of the carrier is renewed by molecular level separation of the wax, which makes it difficult to pollute the carrier surface due to the adhesion of the external additive or toner bulk components.

Examples of the wax include, but not particularly limited, a paraffin wax and derivatives thereof, a montan wax and derivatives thereof, a microcrystalline wax and derivatives thereof, a Fischer Tropsch wax and derivatives thereof, and a polyolefin wax and derivatives thereof. Examples of the derivatives include oxides, polymers with vinyl monomers, and graft modified products. In addition, alcohol, fatty acid, a vegetable wax, an animal wax, a mineral wax, an ester wax, acid amide, or the like may also be used. In addition, any of known waxes may also be used. The melting point of the wax is preferably 60° C. to 200° C., and more preferably 80° C. to 150° C. When the melting point of the wax is lower than 60° C., the fluidity as a carrier may deteriorate.

In order to increase the adhesiveness between the surface of core particles and a coating resin, the core particles may be subjected to coupling treatment. Examples of a coupling agent to be used include a silane coupling agent, silicone oil, a titanate coupling agent, and an aluminum coupling agent. These may be used singly or in combination of two or more. Among the above, a silane coupling agent is preferable.

The conductive powder may be incorporated into the coating layer in such a manner that, for example, in the method (1), the conductive powder is added to the dispersion liquid to be applied onto the surface of the core particles, together with the resin particles and the crosslinking resin in an uncrosslinked state. Alternatively, the conductive powder may be incorporated into the coating layer in such a manner that, for example, in the method (2), the conductive powder is incorporated in advance in a coating layer formed from the crosslinking resin, which is to be applied to the resin particles, or the conductive powder is added to the dispersion liquid. However, the method is not particularly limited to these, and any method capable of incorporating the conductive powder into the coating layer may be used, Developer for Electrophotography A developer for electrophotography according to an exemplary embodiment of the invention (hereinafter sometimes referred to as a "developer of the present exemplary embodiment") includes the previously-described carrier and a toner. The developer of the present exemplary embodiment may be obtained by mixing the carrier and a toner by a known technique.

Toner

A toner to be used in the invention will be described.

The toner to be used in an exemplary embodiment preferably includes a colorant, and may further include other ingredients such as a binder resin.

As the binder resin contained in the toner, any of known binder resins usable for a toner may be suitably selected. Specific examples thereof include homopolymers and copolymers of: monoolefins, such as ethylene, propylene, butylene, or isoprene; vinyl esters, such as vinyl acetate, vinyl propionate, vinyl benzoate, or vinyl butyrate; α-methylene aliphatic monocarboxylic acid esters, such as methyl acrylate, phenyl acrylate, octyl acrylate, methyl methacrylate, ethyl methacrylate, butyl methacrylate, or dodecyl methacrylate; vinyl ethers, such as vinyl methyl ether, vinyl ethyl ether, or vinylbutyl ether; vinyl ketones, such as vinyl methyl ketone, vinyl hexyl ketone, or vinyl isopropenyl ketone; and the like.

Among the above, typical examples of the binder resin include polystyrene, a styrene-alkyl acrylate copolymer, a styrene-butadiene copolymer, a styrene-maleic anhydride copolymer, polystyrene, and polypropylene. In addition, examples include polyester, polyurethane, an epoxy resin, a silicone resin, polyamide, and a modified rosin.

The colorant is not limited, and examples thereof include carbon black, aniline blue, calco oil blue, chrome yellow, ultra marine blue, DuPont oil red, quinoline yellow, methylene blue chloride, phthalocyanine blue, malachite green oxalate, lamp black, rose bengal, C. I. pigment red 48:1, C.I. pigment red 122, C.I. pigment red 57:1, C.I. pigment yellow 97, C.I. pigment yellow 12, C.I. pigment blue 15:1, and pigment blue 15:3.

The toner may further include known other ingredients, such as releasing agents such as low molecular weight polypropylene, low molecular weight polyethylene, or a wax. Examples of the wax include a paraffin wax and derivatives thereof, a montan wax and derivatives thereof, a microcrystalline wax and derivatives thereof, a Fischer Tropsch wax and derivatives thereof, and a polyolefin wax and derivatives thereof. Examples of the derivatives include oxides, polymers with vinyl monomers, graft modified products. In addition, alcohol, fatty acid, a vegetable wax, an animal wax, a mineral wax, an ester wax, acid amide, or the like may be used.

Furthermore, a charge control agent may be added to the toner, as required. When a charge control agent is added to a color toner, a colorless or light-colored charge control agent that does not affect color tone of the toner is preferable. Although any known agents may be used as the charge control agent, it is preferable to use an azo metal complex, or a metal complex or metal salt of salicylic acid or alkyl salicylic acid.

In exemplary embodiments of the invention, an external additive may be blended in the toner, in order to improve transfer properties, fluidity, cleaning properties, and controllability of charge amount, and particularly fluidity.

Examples of the external additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2))n$, $Al_2O_3.2SiO_2$, $CaCO_3$, $MgCO_3$, $BaSO_4$, and $MgSO_4$. Among the above, silica particles and titania particles are particularly preferable because it provides improved fluidity.

The surface of the inorganic particle as the external additive is preferably subjected to hydrophobizing treatment. The hydrophobizing treatment improves powder flowability of a toner and is effective also for improvement of environment dependency of charge and carrier contamination resistance. The hydrophobizing treatment may be performed by immersing inorganic particles in a hydrophobizing agent. The hydrophobizing agent is not limited, and examples thereof include a silane coupling agent, silicone oil, a titanate coupling agent, and an aluminum coupling agent. These hydrophobizing agents may be used singly or in combination of two or more thereof. Among the above, a silane coupling agent is preferable.

The volume average particle diameter of a toner is preferably about 2 μm to about 12 μm, more preferably about 3 μm to about 10 μm, and still more preferably about 4 μm to about 9 μm. When the volume average particle diameter of toner particles is smaller than 2 μm, fluidity extremely decreases. Therefore, the formation of a developer layer using a layer regulation member or device may become insufficient, sometimes resulting in generation of image fogging or a dirt in an image. In contrast, when the volume average particle diameter thereof exceeds 12 μm, the resolution decreases, sometimes resulting in a failure of obtaining a high quality image, or the charge amount per developer unit weight may decrease, and the formation and maintenance properties of the developer layer may decrease, sometimes resulting in generation of image fogging or a dirt in an image.

The volume average particle diameter of toner particles is measured as follows. To a surfactant, which serves as a dispersant, preferably 2 ml of 5% by weight aqueous alkyl benzene sodium sulfonate solution, 0.5 mg to 50 mg of a measurement sample is added. Then, the mixture is added to 100 ml to 150 ml of the dispersion liquid. The dispersion liquid in which the measurement sample has been suspended is dispersed for about 1 minute with an ultrasonic dispersion device. Using a COULTER MULTI-SIZER II (trade name, manufactured by Beckman Coulter, Inc.), the particle size distribution of particles having a particle diameter in the range of 2.0 μm to 60 μm is measured using an aperture having an aperture diameter of 100 μm. The number of particles to be measured is adjusted to 50,000.

An accumulation distribution is drawn from a smaller particle size side with respect to a divided particle size range (channel) in the obtained particle size distribution, and the particle size at which the volume accumulation reaches 50% is defined as a volume average particle diameter D50v.

A method for producing a toner is not particularly limited, and any of known methods such as a dry-type production method, such as a kneading pulverization method or a wet-type granulation method, such as a melting suspension method, an emulsion aggregation method, or a dissolution suspension method, may be used as required, and an emulsion aggregation method is preferable. The emulsion aggregation method is a method for obtaining a toner by performing emulsion polymerization of a polymerizable monomer of a binder resin to form a dispersion liquid, mixing the thus-formed dispersion liquid with a dispersion liquid in which a colorant is dispersed, and with, as required, a releasing agent and/or a dispersion liquid of a charge control agent, followed by aggregation, melting by heating, and coalescence.

The addition of an external additive to the obtained toner is performed by any of known methods or using any of known apparatuses, for example, using a V blender, a Henschel mixer, a Loedige mixer, or the like.

As the mixing ratio (weight ratio) of the toner to the carrier in the developer in the invention, a "toner:carrier" ratio is preferably from 1:100 to 30:100, and more preferably from 3:100 to 20:100.

Developer Cartridge for Electrophotography, Image Forming Device, and Process Cartridge Next, a developer cartridge for electrophotography according to an exemplary embodiment of the invention (hereinafter sometimes referred to as a cartridge) will be described. The cartridge of the present exemplary embodiment is detachably mounted on an image forming apparatus and at least contains a developer to be supplied to a developing device that develops an electrostatic latent image formed on the surface of an image holder into a toner image. The developer is the previously-described developer of the invention.

By using the cartridge of the exemplary embodiment including the developer according to an exemplary embodiment of the invention in an image forming apparatus to which the cartridge is detachably mounted, an image in which generation of a white patch is suppressed may be obtained over a long period of time.

The image forming apparatus according to an exemplary embodiment of the invention at least includes an image holder, a charging device that charges the surface of the image holder, an electrostatic latent image forming device that forms an electrostatic latent image on the surface of the image holder, a developing device that develops the electrostatic latent image using a developer into a toner image, and a transfer device that transfers the toner image onto a recording medium, and the developer is the previously-described developer for electrophotography according to an exemplary embodiment of the invention.

By using the image forming apparatus according the exemplary embodiment, in which the developer according to an exemplary embodiment of the invention is used, an image in which generation of a white patch is suppressed may be obtained over a long period of time.

The image forming apparatus of the invention is not particularly limited as long as the image forming apparatus at least includes an image holder, a charging device, an electrostatic latent image forming device, a developing device, and a transfer device, as described above. In addition, in exemplary embodiments of the invention, a fixation device, a cleaning device, a charge erasing device, or the like may further be provided.

The developing device may employ a structure in which a developer container in which the developer according to an exemplary embodiment of the invention is contained or stored, a developer supply unit that supplies the developer to the developer container, and a developer discharging unit that discharges at least a portion of the developer contained or stored in the developer container, i.e., a trickle development system.

The process cartridge according to an exemplary embodiment of the invention at least has a developer holder and contains or stores the developer according to an exemplary embodiment of the invention. In addition, in a exemplary embodiment, the process cartridge may have another member or device, such as a charge erasing device, as required.

By using the process cartridge according to an exemplary embodiment of the invention in the image forming apparatus to which the process cartridge is detachably mounted, an image in which generation of a white patch is suppressed may be obtained over a long period of time.

Hereinafter, specific examples of the image forming apparatus and the process cartridge according to exemplary embodiments of the invention will be specifically described with reference to the drawings.

Figure 2:
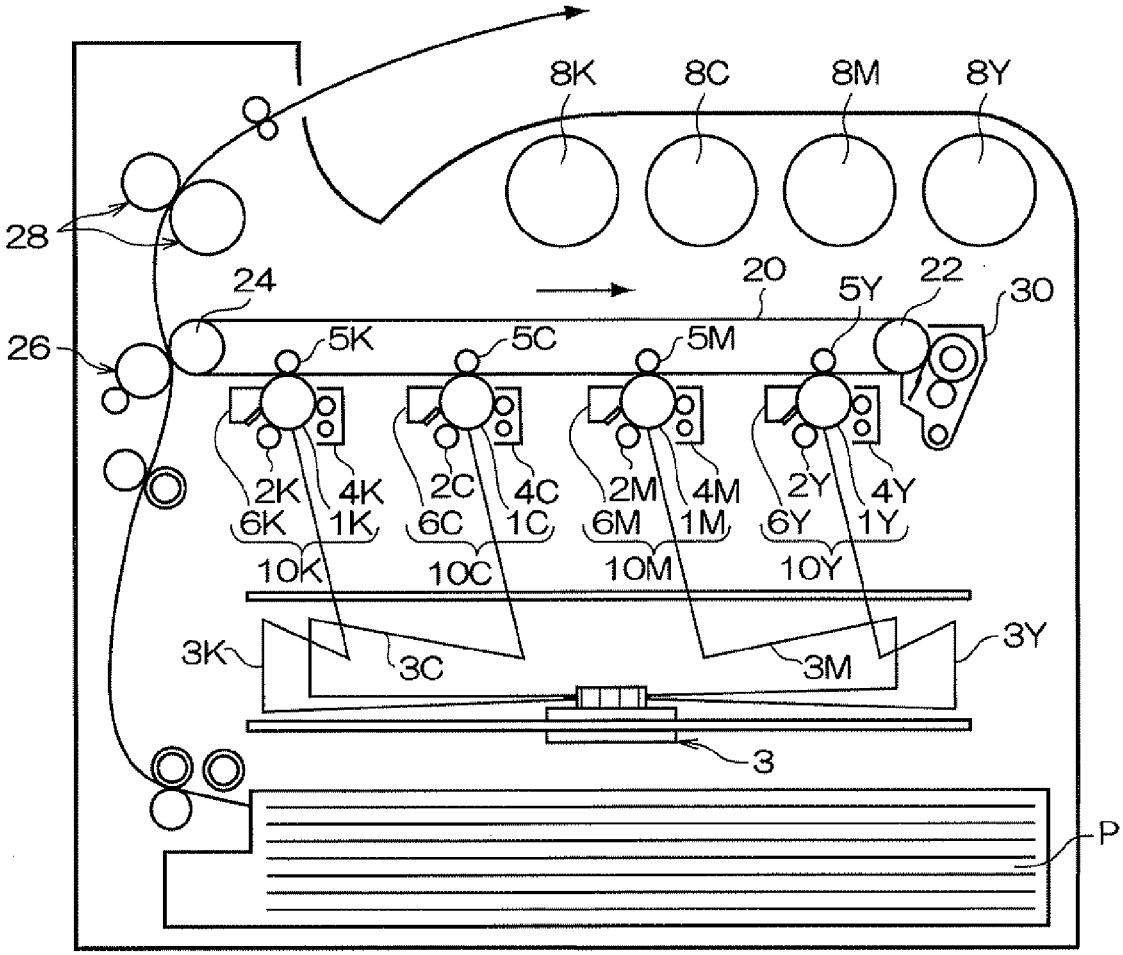
FIG. 2 is a schematic configuration diagram illustrating an example of an image forming apparatus of an exemplary embodiment of the invention.

FIG. 2 is a schematic configuration diagram illustrating an example of an image forming apparatus according to an exemplary embodiment of the invention (which is a quadruple-tandem type full color image forming apparatus). The image forming apparatus illustrated in FIG. 2 has first to fourth electrophotographic image forming units 10Y, 10M, 10C, and 10K (image forming units) that output images of respective colors of yellow (Y), magenta (M), cyan (C), and black (K) based on color separation image data. These image forming units (hereinafter simply referred to as a "unit") 10Y, 10M, 10C, and 10K are disposed in the horizontal direction with given intervals therebetween. These units 10Y, 10M, 10C, and 10K may each be a process cartridge that can be detachably mounted on an image forming apparatus body.

Upward of each of the units 10Y, 10M, 10C, and 10K in the drawing, an intermediate transfer belt 20 as an intermediate transfer body extends through the respective units. The intermediate transfer belt 20 is disposed wound around a driving roller 22 and a support roller 24, which are in contact with the inner surface of the intermediate transfer belt 20, the driving roller 22 and support roller 24 being disposed at positions separated from each other in a horizontal direction in the drawing, and runs in a direction from the first unit 10Y to the fourth unit 10K. The support roller 24 is biased by a spring or the like (not shown) in a direction departing from the driving roller 22, whereby tension is applied to the intermediate transfer belt 20 as wound around both rollers. Furthermore, the intermediate transfer body cleaning device 30 is disposed facing the drive roller 22 on the image carrier surface side of the of the intermediate transfer belt 20.

Toners of four colors of yellow, magenta, cyan, and black contained in toner cartridges 8Y, 8M, 8C, and 8K, respectively, are supplied to respective developing devices (developing devices) 4Y, 4M, 4C, and 4K of respective units 10Y, 10M, 10C, and 10K.

The first to fourth units 10Y, 10M, 10C, and 10K have substantially the same configuration. Therefore, herein, the description is given to the first unit 10Y that is disposed at an upstream side in a running direction of the intermediate transfer belt and forms a yellow image, as a representative. To portions identical with the first unit 10Y, in place of yellow (Y), the reference numeral may be provided with magenta (M), cyan (C) or black (K) and, therefore, descriptions of the units 10M, 10C and 10K will be omitted.

The first unit 10Y has a photoreceptor 10Y which acts as an image holder. Around the photoreceptor 1Y, a charging roller (charging device) 2Y that charges the surface of the photoreceptor 1Y with a given electrical potential, an exposure device (electrostatic latent image forming device) 3 with which the charged surface is exposed with a laser beam 3Y in accordance with a color separation image signal to form an electrostatic latent image, a developing device 4Y that develops the electrostatic latent image by supplying a charged toner to the electrostatic latent image, a primary transfer roller 5Y (primary transfer unit) that transfers the developed toner image onto the intermediate transfer belt 20, and a photoreceptor cleaning device (cleaning device) 6Y that removes the toner remaining on the surface of the photoreceptor 1Y after primary transfer, are disposed in order.

The primary transfer roller 5Y is disposed inside of the intermediate transfer belt 20 and at a position facing the photoreceptor 1Y. Furthermore, a bias power source (not shown) that applies a primary transfer bias is connected to each of the primary transfer rollers 5Y, 5M, 5C, and 5K. Each bias power source changes a transfer bias to be applied to each primary transfer roller by controlling by use of a controller (not shown).

Hereinafter, an operation of the first unit 10Y when a yellow image is formed will be described. Prior to an operation, the surface of the photoreceptor 1Y is charged to an electrical potential of about −600 V to −800 V using the charging roller 2Y.

The photoreceptor 1Y is formed of an electroconductive base material (e.g., having a volume resistivity at 20° C. of $1\times10^{-6}$ Ωcm or lower) and a photosensitive layer disposed on the base material. The photosensitive layer has usually a high resistance (e.g., a resistance substantially the same as that of a usual resin), but, upon irradiation with a laser beam 3Y, the specific resistance of the portion irradiated with the laser beam changes. Then, the laser beam 3Y is output through the exposure device 3 onto the charged surface of the photoreceptor 1Y according to image data for yellow color sent from a controller (not shown). The photosensitive layer on the surface of the photoreceptor 1Y is irradiated with the laser beam 3Y. Thus, an electrostatic latent image of a yellow printed pattern is formed on the surface of the photoreceptor 1Y.

The electrostatic latent image is an image formed on the surface of the photoreceptor 1Y by charging and is a so-called negative latent image that is formed when the specific resistance of a portion of the photosensitive layer irradiated with the laser beam 3Y decreases, whereby the charge which has been present on the surface of the photoreceptor 1Y is erased, while the charge that is present in a portion that is not irradiated with the laser beam 3Y remains.

The electrostatic latent image thus formed on the photoreceptor 1Y is rotated to a given development position according to the rotation of the photoreceptor 1Y. Then, at the development position, the electrostatic latent image on the photoreceptor 1Y is formed into a visible image (developed image) by the developing device 4Y.

The developing device 4Y at least contains: a yellow toner including a yellow colorant and a binder resin and having a volume average particle diameter of 7 μm; and the carrier of the invention, for example. The yellow toner is charged by friction caused by stirring in the developing device 4Y, so as to have a charge having the same polarity (negative polarity) as that of the charge present on the photoreceptor 1Y, and is held on a developer roll (developer holder). Then, when the surface of the photoreceptor 1Y passes through the developing device 4Y, the yellow toner adheres to a latent image portion, in which charges are erased, on the surface of the photoreceptor 1Y, whereby the latent image is developed by the yellow toner. The photoreceptor 1Y on which the yellow toner image has been formed is successively made to run at a given speed, and then the toner image developed on the photoreceptor 1Y is conveyed to a given primary transfer position.

When the yellow toner image on the photoreceptor 1Y is conveyed to the primary transfer position, a given primary transfer bias is applied to the primary transfer roller 5Y, and electrostatic force towards the primary transfer roller 5Y from the photoreceptor 1Y acts on the toner image; as a result, the toner image on the photoreceptor 1Y is transferred onto the intermediate transfer belt 20. The transfer bias applied at this time has a (+) polarity which is opposite to the (−) polarity of the toner. For example, in the first unit 10Y, the transfer bias is controlled to be about +10 μA by a controller (not shown).

The toner remaining on the photoreceptor 1Y is removed by the cleaning device 6Y and collected.

A primary transfer bias applied to each of the primary transfer rollers 5M, 5C, and 5K of the second units 10M and the like, is also controlled in a similar manner to that in the first unit 10Y.

Thus, the yellow toner image which has been transferred by the first unit 10Y onto the intermediate transfer belt 20 is successively conveyed through the second to fourth units 10M, 10C, and 10K, and toner images of the respective colors are transferred and superimposed thereon.

As described above, a photoreceptor 1M, a charging roller 2M, a laser beam 3M, a developing device 4M, a primary transfer roller 5M, a photoreceptor cleaning device 6M, and a toner cartridge 8M in the second unit 10M are equivalent to those in the first unit 10Y.

As described above, a photoreceptor 1C, a charging roller 2C, a laser beam 3C, a developing device 4C, a primary transfer roller 5C, a photoreceptor cleaning device 6C, and a toner cartridge 8C in the third unit 10C are equivalent to those in the first unit 10Y.

As described above, a photoreceptor 1K, a charging roller 2K, a laser beam 3K, a developing device 4K, a primary transfer roller 5K, a photoreceptor cleaning device 6K, and a toner cartridge 8K in the fourth unit 10K are equivalent to those in the first unit 10Y.

The intermediate transfer belt 20 to which the toner image of four colors have been multi-transferred through the first to fourth units conveys the toner image to a secondary transfer position that is located between the intermediate transfer belt 20, the support roller 24 in contact with the inner surface of the intermediate transfer belt 20, and a secondary transfer roller (secondary transfer unit) 26 located at the image holder side of the intermediate transfer belt 20. Meanwhile, a recording paper sheet (recording medium) P is fed to a space between the secondary transfer roller 26 and the intermediate transfer belt 20, which are pressed against each other, by a paper feed mechanism at a given timing, and a given secondary transfer bias is applied to the support roller 24. The transfer bias applied at this time has a (−) polarity which is the same as the polarity (−) of a toner. Thus, electrostatic force towards the recording paper sheet P from the intermediate transfer belt 20 acts on the toner image, whereby the toner image on the intermediate transfer belt 20 is transferred onto the recording paper sheet P. The secondary transfer bias in this case is determined according to an electrical resistance detected by a resistance detector (not shown) that detects the electrical resistance of the secondary transfer portion, and is controlled by changing voltage.

Thereafter, the recording paper sheet P is sent into a fixation device (fixation unit) 28, in which the toner image is heated, and the toner image having multiple colors is melted to be fixed onto the recording paper sheet P. The recording paper sheet P on which the color image is fixed is discharged to a discharging portion to complete a series of color image formation operations.

The image forming apparatus described above as an example has a configuration in which the toner image is transferred to the recording paper sheet P through the intermediate transfer belt 20. However, the configuration is not limited thereto, and the toner image may be directly transferred to the recording paper from the photoreceptor.

Figure 3:
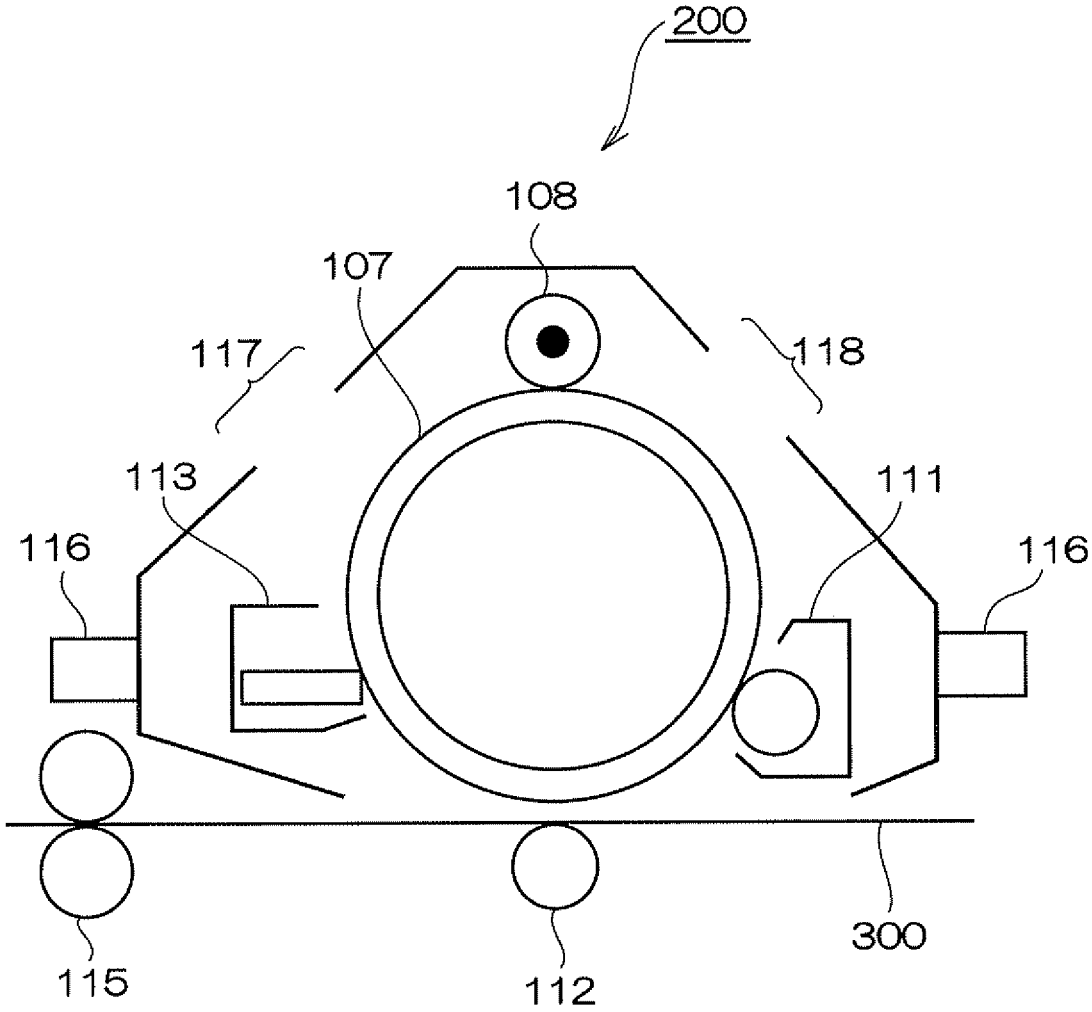
FIG. 3 is a schematic configuration diagram illustrating an example of a process cartridge of an exemplary embodiment of the invention.

FIG. 3 is a schematic configuration diagram illustrating a preferable example of a process cartridge that stores the developer for electrophotography according to an exemplary embodiment of the invention. A process cartridge 200 at least has a photoreceptor (latent image holder) 107, a charging roller (charging unit) 108, a developing device (developing unit) 111, and a photoreceptor cleaning device (cleaning unit) 113, which are assembled and integrated by a mounting rail 116, and has an opening 118 for exposure and an opening 117 for neutralization exposure.

The process cartridge 200 is detachably mounted on an image forming apparatus body including a transfer device (transfer unit) 112, a fixation device (fixation unit) 115, and other components (not shown), and constitutes an image forming apparatus, together with the image forming apparatus body, which forms an image on a recording paper sheet 300.

The process cartridge illustrated in FIG. 3 has the charging device 108, the developing device 111, the cleaning device (cleaning unit) 113, the opening 118 for exposure, and the opening 117 for neutralization exposure. However, these devices may be selectively combined.

The process cartridge of the exemplary embodiment includes the photoreceptor 107, and at least one selected from the group consisting of the charging device 108, the developing device 111, the cleaning device (cleaning unit) 113, the opening 118 for exposure, and the opening 117 for neutralization exposure.

EXAMPLES

Hereinafter, exemplary embodiments of the invention will be specifically described with reference to Examples, but are not limited to these Examples. In the following description, unless otherwise specified, "part(s)" are all "part(s) by weight", and "%" is all "% by weight".

Example 1

MR2932 (trade name, magnetite dispersed phenol resin, particle diameter: 35 μm, manufactured by Toda Kogyo Corporation) is used as core particles. MP1451 (trade name, PMMA, particle diameter: 150 nm, manufactured by Soken Chemical & Engineering) is used as resin particles. 20SE60 (trade name, melamine resin, manufactured by Mitsui Chemical Co., Ltd.) is used as a crosslinking resin in an uncrosslinked state. Ketjenblack EC (trade name, carbon black, manufactured by Mitsubishi Chemical Corporation) is used as conductive powder.

In a solution in which 1.9 parts of resin particles are dissolved in 10 parts of methanol, 0.1 part of the crosslinking resin and 0.2 part of the conductive powder are put in the stated order. The mixture was stirred for 5 minutes with a homogenizer to obtain a dispersion liquid. Next, the thus-obtained dispersion liquid and 100 parts of core particles are put in a kneader (manufactured by Inoue Manufacturing Co., Ltd.), and stirred at a rate of 20 rpm while heating to 70° C. under vacuum, thereby applying the crosslinking resin in an uncrosslinked state, the resin particles, and the conductive powder onto the surface of the core particles.

Next, the core particles to which the crosslinking resin in an uncrosslinked state, the resin particles, and the conductive powder have been applied are put in NOBILTA (trade name, manufactured by Hosokawa Micron Corporation), and the mixture was stirred at 1,500 rpm for 40 minutes, to apply a mechanical impact to the mixture.

The core particles to which a mechanical impact was applied is put in a rotary kiln (manufactured by ADVANTEC), and stirred at 200° C. for 20 minutes, thereby crosslinking 20SE60 as the crosslinking resin in an uncrosslinked state. After cooling, the resultant is sieved through a 75-μm mesh, thereby producing a carrier of Example 1 in which the amount of a resin constituting resin particles in a coating layer is 95%.

Example 2

A carrier of Example 2 in which the amount of a resin constituting resin particles in a coating layer is 85% is produced in a manner substantially similar to Example 1, except that the amount of the resin particles used in Example 1 is changed to 1.7 parts, and the amount of the crosslinking resin used in Example 1 is changed to 0.3 parts.

Example 3

A carrier of Example 3 in which the amount of a resin constituting resin particles in a coating layer is 50% is produced in a manner substantially similar to Example 1, except that the amount of the resin particles used in Example 1 is changed to 1.0 parts, and the amount of the crosslinking resin used in Example 1 is changed to 1.0 parts.

Comparative Example 1

A carrier of Comparative Example 1 in which the amount of a resin constituting resin particles in a coating layer is 100% is produced in a manner substantially similar to Example 1, except that no crosslinking resin is used, and the amount of the resin particles used in Example 1 is changed to 2.0 parts.

Example 4

A carrier of Example 4 in which the amount of a resin constituting resin particles in a coating layer is 85% is produced in a manner substantially similar to Example 2, except that the resin particles used in Example 2 is changed to LUBRON (trade name, PTFE, particle diameter: 200 nm, manufactured by Daikin, LTD.).

Example 5

A carrier of Example 5 in which the amount of a resin constituting resin particles in a coating layer is 85% is produced in a manner substantially similar to Example 2, except that the crosslinking resin used in Example 2 is changed to SR2411 (trade name, silicone resin, manufactured by Shin-Etsu Chemicals Co., Ltd.).

Example 6

A carrier of Example 6 in which the amount of a resin constituting resin particles in a coating layer is 85% is produced in a manner substantially similar to Example 2, except that the conductive powder used in Example 2 is changed to S2000 (trade name, tin oxide, manufactured by MITSUBISHI MATERIALS CORPORATION).

Example 7

A carrier of Example 7 in which the amount of a resin constituting resin particles in a coating layer is 85% is produced in a manner substantially similar to Example 2, except that the core particles used in Example 2 is changed to EF351 B (trade name, ferrite, particle diameter: 35 μm, manufactured by Powdertech Co., Ltd.).

Comparative Example 2

A carrier of Comparative Example 2 in which the amount of a resin constituting resin particles in a coating layer is 85% is produced in a manner substantially similar to Example 2, except that the mechanical impact is not applied.

Production of Developer 1 part of a toner (a toner used in an ApeosPort C6500 developing device, manufactured by Fuji Xerox Co., Ltd.) and 100 parts of the respective carriers obtained in Examples 1 to 7 and Comparative Examples 1 and 2 are stirred using a V-blender at 40 rpm for 20 minutes. The resultant products are each sieved through a sieve having a 212-μm opening, thereby obtaining developers of Examples 1 to 7 and Comparative Examples 1 and 2.

Evaluation

Using each of the developers of Examples 1 to 7 and Comparative Examples 1 and 2 and using an ApeosPort C6500 developing device (manufactured by Fuji Xerox Co., Ltd.), 100,000 images with an image density of 10% are formed and, after the printing, 100,000 black solid images are printed at 25° C. and 50% HR. Then, the following evaluation is carried out. The results are shown in Table 1.

Residual Ratio of Coating Layer of Carrier

The toner is blown away from each developer before the image formation and after the formation of 100,000 images. The carriers before the image formation and the carriers after the formation of 100000 images are extracted. Each carrier is heated to 900° C. under a nitrogen atmosphere by thermogravimetric analysis (TGA). Then, a coating layer residual ratio is calculated from heat weight loss. At this time, the heat weight loss of the core particles is measured in advance, and the coating amount is calculated from the difference between the heat weight loss of the carrier and the heat weight loss of the core particle; and the coating layer residual ratio is calculated from this value.

Volume Resistivity

The volume resistivity of the carriers before the image formation and the carriers after the formation of 100,000 images, which are obtained as described above, is measured using a C6500 resistance bench under the conditions of 25° C. and 55% RH. Specifically, the C6500 resistance bench includes a developing device of the C6500 image forming apparatus and an aluminum element tube having the same diameter as that of the photoreceptor of the C6500 apparatus, and the developing device and the aluminum element tube are connected to wiring. A voltage is applied using a high voltage power supplier (manufactured by TREC), and the volume resistivity is measured using a KETHLEY ammeter.

Number of Carriers Flying to Images

The number of flying carriers is counted for an A3 image formed on the first sheet and an A3 image formed on the 100,000th sheet. Evaluation is performed under the following criteria.

A: Number of the carriers is 3 or lower.

B: Number of the carriers is 4 to 9.

C: Number of the carriers is 10 or more.

Rate of Charge Reduction

In the first stage and after the formation of 100,000 sheets, the developer on the surface of a mag sleeve (developer holder) in the developing device is extracted. The charge amounts are measured using TB200 (trade name, manufactured by Toshiba Chemical Corporation) under the conditions of 25° C. and 55% RH, and the rate of charge reduction is calculated.

Fogging

The presence of fogging is checked in blank portions of the first sheet and the 100,000th sheet. A sheet in which fogging cannot be observed even when observed using a ×50 magnifying lens is evaluated as "A", a sheet in which fogging is observed using the ×50 magnifying lens but is not visually observed is evaluated as "B", and the sheet in which fogging is visually observed is evaluated as "C".

TABLE 1

| Evaluation results | Coating layer residual ratio of carrier | Volume resistivity (LogΩcm) | | Number of carriers flying to image | | Charge reduction rate | Fogging | |
|---|---|---|---|---|---|---|---|---|
| | | Initial stage | After formation of 100,000 images | Initial stage | After formation of 100,000 images | | Initial stage | After formation of 100,000 images |
| Ex. 1 | 76% | 11.2 | 8.8 | A | B | 78% | A | A |
| Ex. 2 | 93% | 11.4 | 10.8 | A | A | 84% | A | A |
| Ex. 3 | 88% | 10.9 | 10.0 | A | A | 61% | A | B |
| Comp. Ex. 1 | 43% | 11.3 | 6.7 | A | C | 43% | A | C |
| Ex. 4 | 82% | 11.5 | 9.8 | A | A | 77% | A | A |
| Ex. 5 | 84% | 10.7 | 9.6 | A | A | 72% | A | A |
| Ex. 6 | 85% | 12.3 | 11.0 | A | A | 71% | A | A |
| Ex. 7 | 83% | 10.4 | 9.4 | A | A | 70% | A | A |
| Comp. Ex. 2 | 52% | 11.0 | 7.3 | A | C | 48% | A | C |

What is claimed is:

1. A method of producing a carrier for electrophotography, comprising:

preparing a dispersion liquid comprising resin particles onto which a crosslinking resin in an uncrosslinked state has been applied;

covering a surface of a core particle with a coating layer comprising the dispersion liquid, the crosslinking resin being present in an uncrosslinked state between the resin particles;

applying a mechanical impact from the outer surface of the coating layer before crosslinking of the crosslinking resin; and crosslinking the crosslinking resin, wherein the mechanical impact is applied by mixing the core particles on which the coating layer has been formed using a dry-type processing device.

2. The method of producing a carrier for electrophotography according to claim 1, wherein an amount of resin forming the resin particles in the coating layer is from about 50% by weight to about 98% by weight of the coating layer.

3. The method of producing a carrier for electrophotography according to claim 1, wherein the coating layer further comprises a conductive powder.

4. The method of producing a carrier for electrophotography according to claim 3, wherein the conductive powder has a volume average particle diameter of from about 10 μm to 100 μm.

5. The method of producing a carrier for electrophotography according to claim 3, wherein an amount of the conductive powder in the coating layer is from about 1% by weight to about 50% by weight of the coating layer.

6. The method of producing a carrier for electrophotography according to claim 3, wherein the conductive powder comprises carbon black.

7. The method of producing a carrier for electrophotography according to claim 3, wherein a primary particle diameter of the conductive powder is from about 10 nm to about 2 μm.

8. The method of producing a carrier for electrophotography according to claim 1, wherein the resin particles have a particle diameter of from about 30 nm to about 10 μm.

9. The method of producing a carrier for electrophotography according to claim 1, wherein the carrier has a shape factor SF1 of from about 100 to about 130.

10. The method of producing a carrier for electrophotography according to claim 1, wherein crosslinking of the crosslinking resin takes place from the outer surface of the coating layer as a result of a heat stimulus being applied.

11. A method of producing a developer for electrophotography, comprising:

producing a carrier for electrophotography by preparing a dispersion liquid comprising resin particles onto which a crosslinking resin in an uncrosslinked state has been applied, covering a surface of a core particle with a coating layer comprising the dispersion liquid, the crosslinking resin being present in an uncrosslinked state between the resin particles, applying a mechanical impact from the outer surface of the coating layer before crosslinking of the crosslinking resin, and crosslinking the crosslinking resin; and mixing the carrier and a toner, wherein the mechanical impact is applied by mixing the core particles on which the coating layer has been formed using a dry-type processing device.

12. The method of producing a developer for electrophotography according to claim 11, wherein the toner has a volume average particle diameter of from about 2 μm to about 12 μm.

13. The method of producing a developer for electrophotography according to claim 11, wherein crosslinking of the crosslinking resin takes place from the outer surface of the coating layer as a result of a heat stimulus being applied.

* * * * *